US008302446B2

(12) United States Patent
Bohland et al.

(10) Patent No.: US 8,302,446 B2
(45) Date of Patent: Nov. 6, 2012

(54) ROLL STAND

(75) Inventors: Michael Bohland, Kreuztal (DE); Juri Schulmeister, Gummersbach (DE); Markus Wagener, Netphen (DE)

(73) Assignee: SMS Siemag AG, Duesseldorf (DE)

( * ) Notice: Subject to any disclaimer, the term of this patent is extended or adjusted under 35 U.S.C. 154(b) by 643 days.

(21) Appl. No.: 12/516,640

(22) PCT Filed: Oct. 25, 2007

(86) PCT No.: PCT/EP2007/009269

§ 371 (c)(1),
(2), (4) Date: Jun. 28, 2009

(87) PCT Pub. No.: WO2008/064751

PCT Pub. Date: Jun. 5, 2008

(65) Prior Publication Data

US 2010/0071433 A1 Mar. 25, 2010

(30) Foreign Application Priority Data

Nov. 29, 2006 (DE) ..... 10 2006 056 317

(51) Int. Cl.
*B21B 39/00* (2006.01)
*B21B 31/00* (2006.01)

(52) U.S. Cl. ..... 72/250; 72/237

(58) Field of Classification Search ..... 72/250, 72/247, 428, 240, 251, 237
See application file for complete search history.

(56) References Cited

U.S. PATENT DOCUMENTS

| | | | | |
|---|---|---|---|---|
| 2,184,118 | A | 12/1939 | Glenn | 80/51 |
| 3,593,554 | A | 7/1971 | Swift | 72/238 |
| 4,186,570 | A * | 2/1980 | Pokrandt | 403/2 |
| 5,038,594 | A * | 8/1991 | Svagr et al. | 72/250 |
| 2009/0217727 | A1 * | 9/2009 | Hanke | 72/250 |

FOREIGN PATENT DOCUMENTS

| | | |
|---|---|---|
| DE | 1602172 | 3/1970 |
| DE | 2129337 | 3/1973 |
| DE | 10116988 | 10/2002 |
| GB | 736896 | 9/1955 |

* cited by examiner

*Primary Examiner* — Dana Ross
*Assistant Examiner* — Pradeep C Battula
(74) *Attorney, Agent, or Firm* — Andrew Wilford

(57) ABSTRACT

The invention relates to a roll stand (1) with a number of rollers (2, 3) and with an incoming guide (4) and/or an outgoing guide (5) which is/are fixed on the roll stand (1) before or after the rolling gap (6) in the rolling direction (W), respectively, and which is/are adjustably arranged in the direction perpendicular to the axis (7) of the rollers (2, 3) and perpendicular to the rolling direction (W), particularly in the vertical direction (V). To minimize damage in case of an accident, the invention provides for a predetermined breaking point (9) in the fixing means which fixes the incoming guide (4) and/or the outgoing guide (5) on the roll stand (1).

18 Claims, 4 Drawing Sheets

ROLL STAND

CROSS REFERENCE TO RELATED APPLICATIONS

This application is the US national stage of PCT application PCT/EP2007/009269, filed 25 Oct. 2007, published 5 Jun. 2008 as WO2008/064751, and claiming the priority of German patent application 102006056317.4 itself filed 29 Nov. 2006, whose entire disclosures are herewith incorporated by reference.

FIELD OF THE INVENTION

The invention relates to a roll stand comprising a plurality of rolls, an intake or output guide attached to the roll stand in the rolling direction upstream or downstream of the rolling gap and adjustable in a direction perpendicular to the axis of the rolls and perpendicular to the rolling direction, in particular vertically.

BACKGROUND OF THE INVENTION

Roll stands of this type are well known. DE 101 16 988 discloses a roll stand comprising means for lifting or lowering the intermediate rolls when the working rolls are changed. The roll rails are mounted on a guide along which they can be moved vertically. A similar solution is known from DE 1 940 414 [U.S. Pat. No. 3,593,554].

The intake and output guides, which are vertically adjustable, are mounted on the roll stands and must accommodate operating forces in the horizontal direction. This results from the purpose of the guides which is to guide the material to be rolled into the rolling gap. To this end, the intake or output guides have a guide surface aligned at an acute angle to the rolling direction.

It has been found in this regard that significant damage can occur in the event there is an accident during operation of the rolling unit, i.e. whenever a slab, a sheet, or a strip does not follow the correct path and strikes the intake or output guide. Considerable damage can then result due to the fact that the forces of impact are transmitted from the intake or output guide to the roll stand. In particular, the guide surfaces for the intake or output guides on the roll stand, or on the corresponding surrounding components, can be damaged when this occurs.

OBJECT OF THE INVENTION

The object of this invention is thus to develop a roll stand of the above-described type kind so as to reduce the level of damage in case of an accident. The object to be attained here is that significant damage no longer results in response to an unwanted collision of the rolled stock with the intake or output guides.

SUMMARY OF THE INVENTION

The solution to this problem provided by the invention is characterized in that the fasteners affixing the intake guide and/or the output guide to the roll stand have a predetermined breaking point.

Provision is preferably made here whereby the fasteners have at least one necked-down bolt. The predetermined breaking point can in this case be designed as a region of reduced cross section incorporated in the necked-down bolt. The axis of the necked-down bolt preferably extends in the rolling direction.

In order to be able to affix the intake and output guide to the roll stand in a manner that is easy to install, in one preferred embodiment of the invention provision is made whereby the fasteners have at least two holding bars that extend perpendicular to the axis of the rolls and perpendicular to the rolling direction, i.e. vertically, and that have passing through them at least one necked-down bolt and are anchored by this bolt. Provision can furthermore be made here whereby at least two of the holding bars, as viewed in the rolling direction, engage the supporting faces of a support element that is permanently fixed to the roll stand. In addition, it is advantageous if a third holding bar that holds the two holding bars at a predetermined is provided between the two holding bars.

Bearings can be provided between the holding bars and the is support elements; these are advantageously designed as slide plates.

In order to attach the intake or output guide to the holding bar(s), provision is made in a development of the invention whereby the connection between the intake guide or output guide and at least one of the holding bars is via a key that fits partly into the holding bar and partly into the intake or output guide in a direction perpendicular to the axis of the rolls and perpendicular to rolling direction, in particular, vertically.

Provision is therefore made according to the invention whereby specific measures are taken to reduce the potential for damage in the event of accident. In the design according to the invention, the intake and output guides do not incur any excessive damage in the event of a collision. As a result, it is possible in particular to avoid relatively long down times for the rolling unit, as is typically the case today when there is an accident. In addition, collision-related repair costs are significantly reduced.

In the event of an accident, there is thus an improved and faster ability to repair the rolling unit; the cost associated with repairing the damage is this significantly lower than is the case with previously known solutions.

BRIEF DESCRIPTION OF THE DRAWING

An embodiment of the invention is illustrated in the drawing. In the drawing.

DETAILED DESCRIPTION

Figure 1:
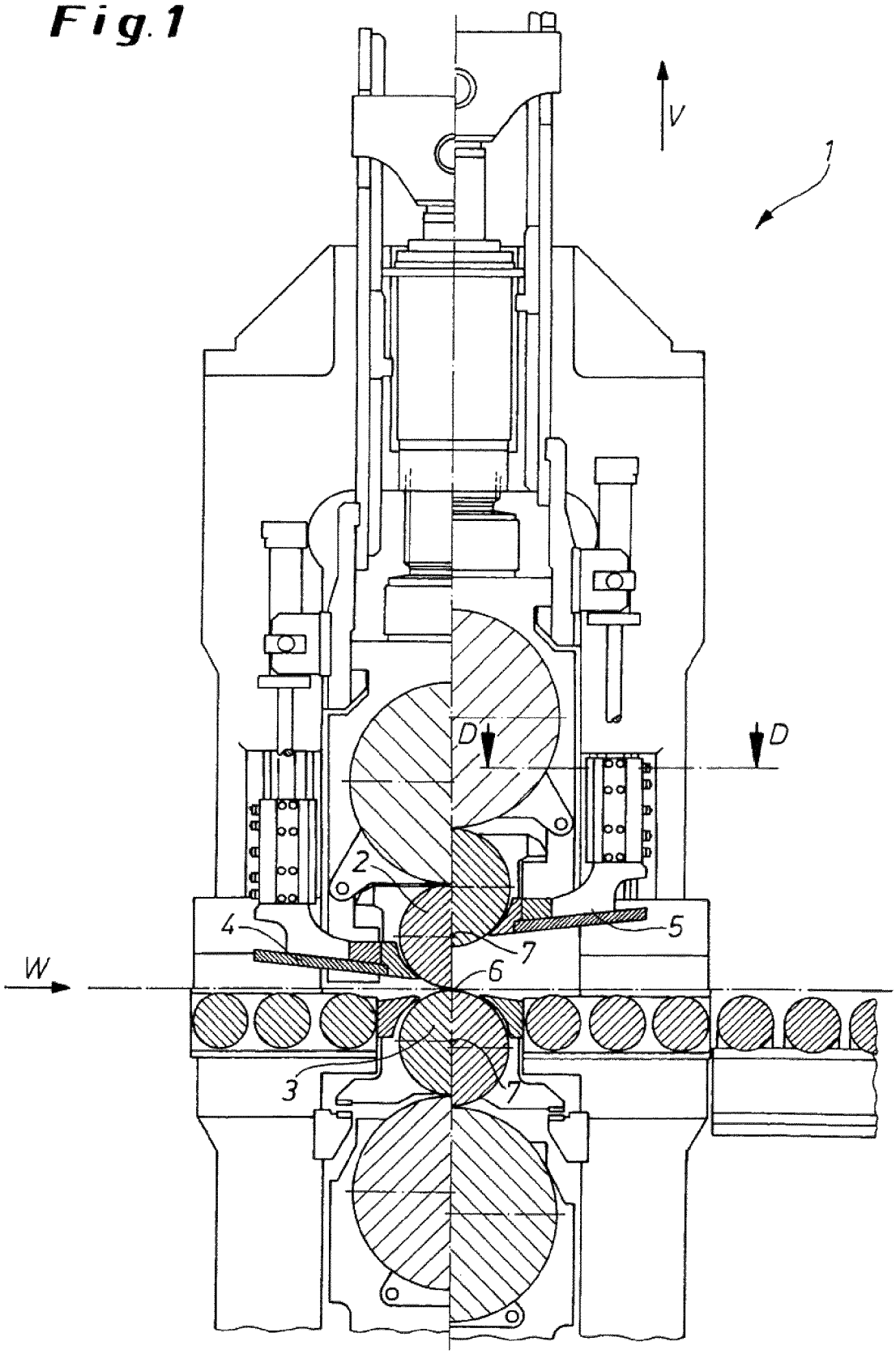
FIG. 1 shows a section through a roll stand, where the axes of the rolls are perpendicular to the plane of the view.

FIG. 1 shows a roll stand 1 of a rolling mill, the roll stand being constructed in an essentially known manner. The (work) rolls 2 and 3 of the roll stand are shown at various vertical positions on both sides of the center plane, i.e. having a varying rolling nip 6 between rolls 2 and 3. Axes 7 of rolls 2 and 3 here are oriented perpendicular to the drawing plane. An intake guide 4 and an output guide 5 are located in the known manner in rolling direction W upstream and downstream of rolls 2 and 3. The two guides 4 and 5 can be adjusted in the vertical direction V.

Figure 2:
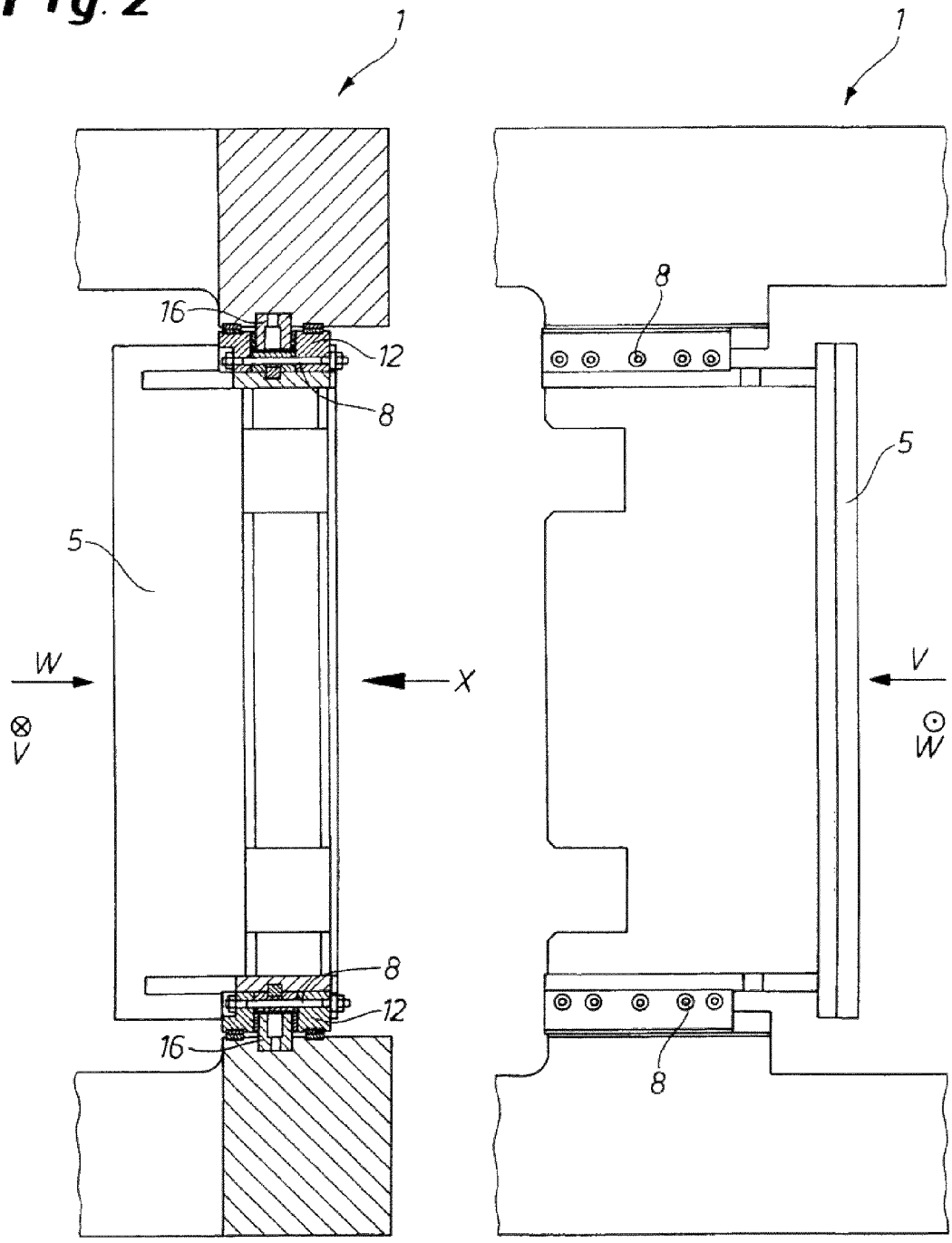
FIG. 2 is a partly sectional top view omitting various details of the roll stand and the intake and output guides along section line D-D of FIG. 1, as well as a side view in direction X.

FIG. 2 is a top view corresponding to FIG. 1 as indicated by section D-D of FIG. 1. Shown here once again is guide 4 and 5, as well as their lateral guide assemblies that make them adjustable or movable in the direction of vertical axis V.

One support element 16 is mounted on each side of the roll stand 1, this element being designed as an elongated rail extending parallel to the vertical V. Along the sides of guides 4 and 5, these support elements 16 are enclosed in a U-shaped fashion by holding bars 12 and 13 attached to the guides 4 and 5.

Figure 3:
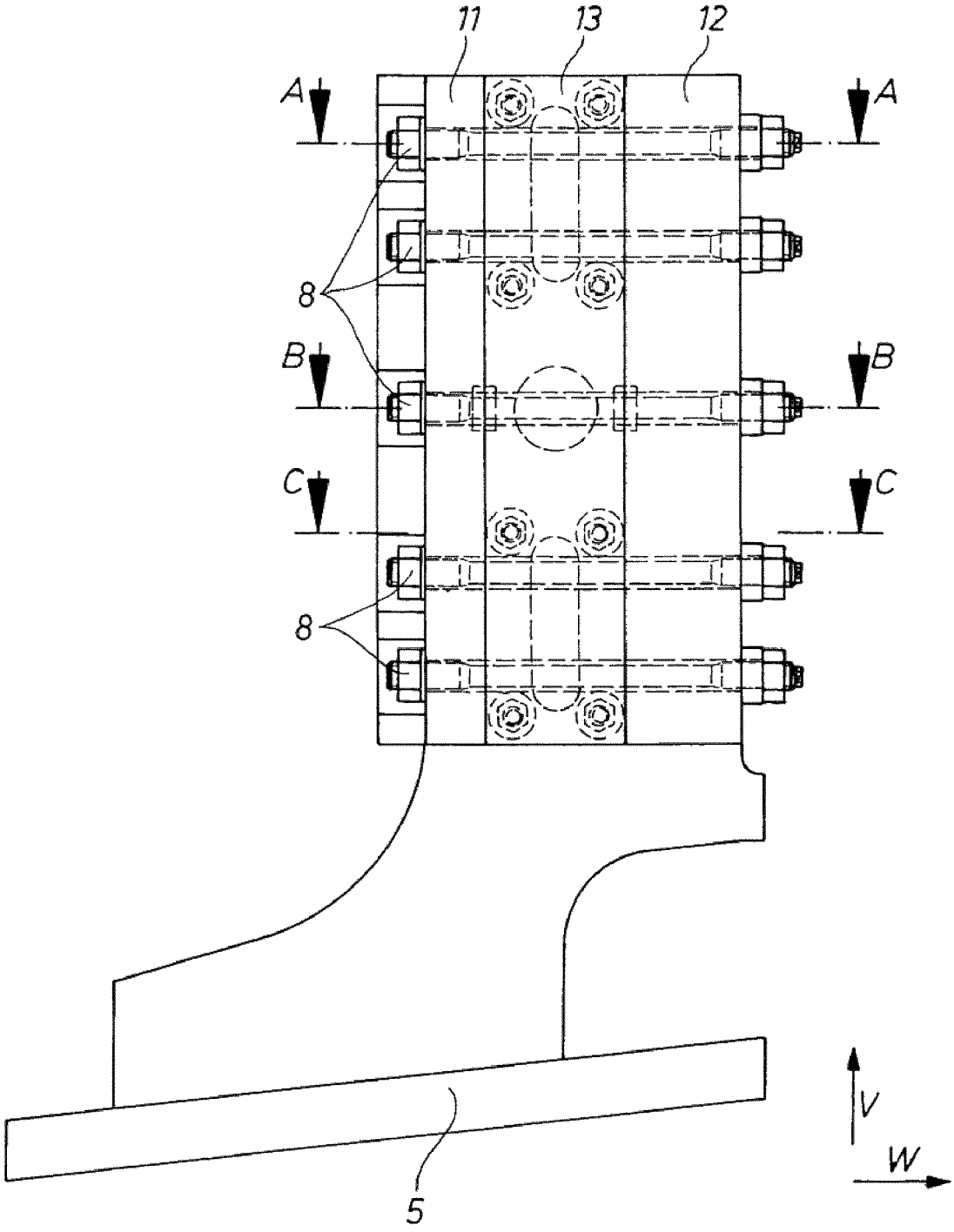
FIG. 3 is an enlarged view of the output guide shown on the right in FIG. 1.

Details of construction here are shown in FIG. 3. The output guide 5 along with the arrangement shown at the top in FIG. 3 is fastened to the roll stand 1, thereby enabling the guide 5 to be displaced along the vertical V. Fasteners 8 secure the output guide 5 to the roll stand 1. In this case—see the detailed sectional views in the synopsis in FIGS. 4 through 6—these are designed as bolt assemblies, the fasteners 8 comprising a bolt whose axis extends in the rolling direction W. As is clear, the bolt passes through holding bars 11, 12, and 13 that together are U-shaped and form a groove in which the support element 16 rides. The holding bar 11 here (see FIGS. 4 through 6) rests on a support face 14 of the rail 16. Analogously, the holding element 12 rests on an opposing supporting face 15 of the rail 16.

The three holding bars 11, 12, 13 together with the rail 16 thus form a linear guide for movement of the output guide 5 along the vertical axis V. In order to provide smooth displacement of the output guide 5 along the vertical axis V, bearings 17 are provided between the holding bars 11 and 12, and the rail 16. These bearings 17 are also provided between the holding bars 11 and 12, and the roll stand 1 so as to ensure a uniformly low-wear bearing arrangement. A fixed connection between the output guide 5 and the holding bar 13 is formed here by a keys 18 that fit in seats of the output guide 5 and of the holding bar 13 (see FIGS. 4 and 5). The connection itself is created by bolts that connect the holding bar 13 to the output guide 5 (see FIG. 6).

The bolts 8 connect the holding bars 11, 12, and 13 and the rail 16, and the tightening torque of the bolts defines the prestress of the bearing arrangement.

It is a critical aspect that the fasteners 8 fixing the intake guide 4 or the output guide 5 to the roll stand 1 have predetermined break points 9. In this case, this is achieved by designing the bolts as necked-down bolts, i.e. they have a region 9 of reduced cross section that provides a weakening in the cross-section of the bolt shaft. In the event of an accident, i.e. if a slab or the like strikes the intake output guide 4 or 5, the impact of the accident is transmitted through the necked-down bolts of the guide 4 and 5 to the roll stand 1. In the process the necked-down bolts then constitute predetermined break points, i.e. the bolt shaft breaks as a result of the impact. As a result, the positive connection by which guides 4 and 5, are retained in the installed state on the roll stand 1 is overridden.

By appropriately sizing the region 9 of reduced cross section, it is possible to ensure that while forces are transmitted through guides 4 and 5 to roll stand 1 during normal operation, a breaking away of the bolts nevertheless occurs in the event of an accident, thereby preventing the entire guide arrangement and roll stand 1 itself from incurring damage as a result of an accident.

The provided predetermined breaking points for fastening the intake or output guides 4 and 5 to the roll stand 1 are unknown in the prior art. The result in that case is that the damage caused by an accident is significant. This is no longer the case with the proposed solution. In particular, what is prevented is any significant deformation of the guides since the guides detach from the roll stand in a timely manner beforehand.

Figure 4:
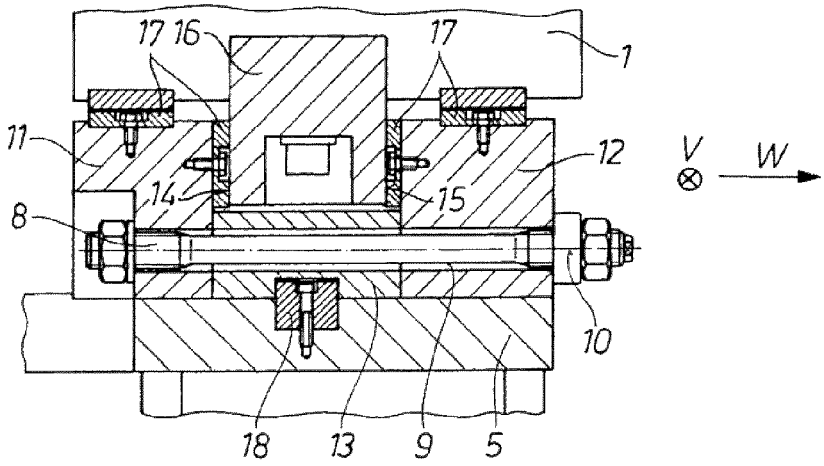
FIG. 4 shows section A-A as indicated in FIG. 3.
Figure 5:
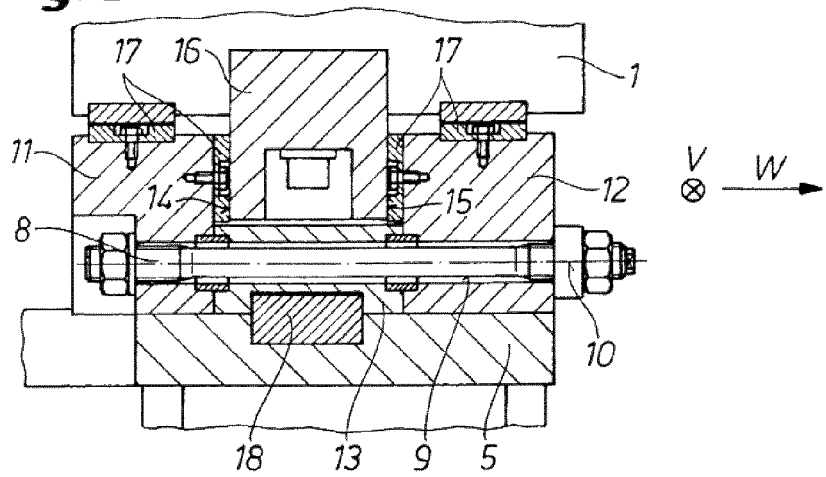
FIG. 5 shows section B-B as indicated in FIG. 3.
Figure 6:
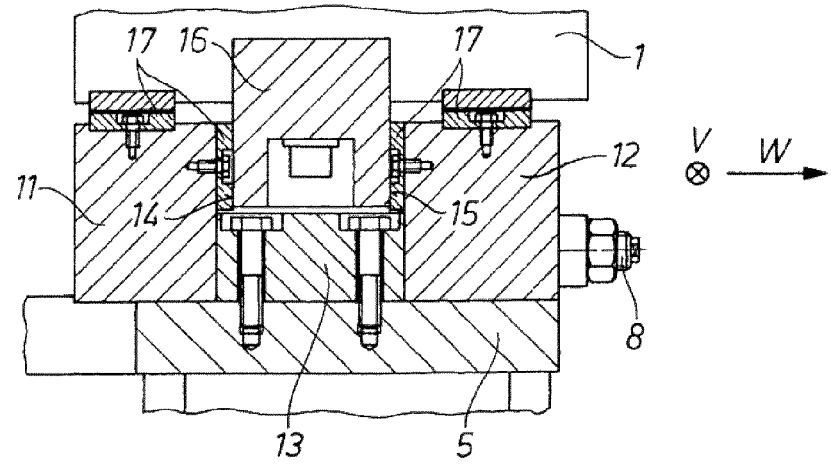
FIG. 6 shows section C-C as indicated in FIG. 3.

As is clear in particular in FIGS. 4 through 6, the positive fit—as viewed in rolling direction W—between the intake or output guides 4 and 5 and roll stand 1 is created through holding bars 11 and 12 that rest on supporting faces 14 and 15. Since the connection of the holding bars 11, 12, 13 is created only through the necked-down bolts, the positive-fitting connection is overridden when the bolts break.

As a result, the remaining components are reliably protected against greater consequential damage.

The holding bars 11, 12, 13 are of simple construction and can be fabricated inexpensively. Replacement as required is a simple matter.

The invention claimed is:

1. A roll stand comprising a frame;

a plurality of rolls in the frame defining a horizontally open rolling gap and rotatable about respective horizontal axes;

an intake or output guide on the roll stand in the rolling direction upstream of or downstream of the rolling gap, and adjustable relative to the frame in a direction perpendicular to the axes of the rolls and perpendicular to a horizontal rolling direction;

an rail fixed on the frame;

a holding bar fixed on the frame and vertically slidable along the rail; and necked-down bolts fasteners attaching the bar and the element together against relative horizontal movement and having a predetermined breaking point, whereby excessive horizontal force applied to the guide breaks the bolt and separates the guide from the frame.

2. The roll stand according to claim 1 wherein the predetermined breaking point is designed as a region of reduced cross section incorporated in the necked-down bolt.

3. The roll stand according to claim 1 wherein the necked-down bolt extends in the rolling direction.

4. The roll stand according to claim 1 wherein there are first and second such holding bars horizontally spaced from each other and fixed to the guide, the element being fixed to the frame and having support faces on which the holding bars bear in the rolling direction.

5. The roll stand according to claim 4, the stand further comprising:

a third holding bar fixed to the guide between the first and second holding bars, the third bar holding the first and second holding bars at a predetermined horizontal spacing.

6. The roll stand according to claim 5, further comprising:

a key between the frame and at least one of the holding bars in a direction perpendicular to the axes of the rolls and perpendicular to the rolling direction.

7. The roll stand according to claim 4 wherein bearings are provided between the holding bars and the support element.

8. The roll stand according to claim 7 wherein the bearings are slide plates.

9. A roll stand comprising: a frame; a pair of vertically spaced working rolls mounted on the frame and defining a nip; a generally horizontal guide plate upstream or downstream of the nip; at least one vertical frame rail on the frame; a support vertically shiftable on the rail and carrying the guide plate to guide a workpiece moving in a horizontal travel direction through the nip and bolts securing the support and guide plate against movement in the direction relative to the frame, the bolts having break points of such a strength that, in the event of a collision of the workpiece with the guide plate, the bolts break at their break points before the plate, support, or frame are damaged.

10. The roll stand defined in claim 9 wherein the support includes a vertical guide-plate rail fixed on the guide plate and vertically slidable on the frame rail.

11. The roll stand defined in claim 10 wherein there are two of the guide-plate rails and they form a vertical groove in which the frame rail fits and slides.

12. The roll stand defined in claim 11 wherein the guide-plate rail is formed by two horizontally spaced side bars flanking the frame rail, the bolts extending in the direction through the bars.

13. The roll stand defined in claim 12 wherein the guide-plate rail includes a middle bar sandwiched between the side bars, the bolts passing through the middle and side bars.

14. The roll stand defined in claim 13 wherein the middle bar is bolted to the guide plate.

15. The roll stand defined in claim 13, further comprising at least one key fitting into the guide plate and into the middle bar.

16. The roll stand defined in claim 12 wherein there are two such plate guide rails flanking the guide plate and riding in respective frame rails.

17. The roll stand defined in claim 12 wherein the bolts are necked-down bolts each with a region of reduced cross section.

18. The roll stand defined in claim 10 wherein the guide plate is generally planar and extends at a small acute angle to the direction.

* * * * *